United States Patent [19]

Kratzenberg

[11] Patent Number: 4,619,615

[45] Date of Patent: Oct. 28, 1986

[54] EQUIPMENT FOR MONITORING COMBAT VEHICLES, ESPECIALLY TANKS

[75] Inventor: Wolfgang Kratzenberg, Staufenberg, Fed. Rep. of Germany

[73] Assignee: Wegmann & Co. GmbH, Kassel, Fed. Rep. of Germany

[21] Appl. No.: 647,077

[22] Filed: Sep. 4, 1984

[30] Foreign Application Priority Data

Sep. 9, 1983 [DE] Fed. Rep. of Germany ..... 3332582

[51] Int. Cl.[4] ..... G09B 9/00

[52] U.S. Cl. ..... 434/22; 434/16; 340/518; 358/194.1

[58] Field of Search ..... 434/16, 20, 21, 22; 340/518, 691; 358/194.1

[56] References Cited

U.S. PATENT DOCUMENTS 4,439,156 3/1984 Marshall et al. ..... 434/22
4,533,327 8/1985 Kratzenberg et al. ..... 434/20

FOREIGN PATENT DOCUMENTS 2078914 1/1982 United Kingdom ..... 434/22

*Primary Examiner*—Leo P. Picard

*Attorney, Agent, or Firm*—Sprung Horn Kramer & Woods

[57] ABSTRACT

Equipment for monitoring combat vehicles, especially tanks, firing practice firing with simulated rounds. Each combat vehicle has a laser that emits a pulse of light when the firing button is pressed and devices to receive and display an arriving pulse of light. A television pickup is coupled to a monitoring or targeting device in each combat vehicle and can be connected through a video section with a television monitor at a director's post. At the director's post there are at least two television monitors, each assigned to a given group of combat vehicles. As long as none of the firing buttons in any of the combat vehicles are pressed, the image supplied from the monitoring or targeting device in a selected combat vehicle will appear on each television monitor. When a firing button is pressed in one of the vehicles, the image supplied from the monitoring or targeting device in that vehicle will appear on the monitor associated with the vehicle for a predetermined period of time. Once the predetermined period of time has expired, the image supplied from the selected combat vehicle will appear again.

15 Claims, 5 Drawing Figures

EQUIPMENT FOR MONITORING COMBAT VEHICLES, ESPECIALLY TANKS

BACKGROUND OF THE INVENTION

The present invention relates to equipment for monitoring combat vehicles, especially tanks, in the practice firing of simulated rounds, with a laser mounted in each combat vehicle and emitting, when the weapon's firing button is pressed, at least one pulse of light in a direction determined by the weapon or by optical targeting devices and with an optical-pulse receiver mounted in each combat vehicle and connected to displays mounted in it for intercepting the optical pulse.

Equipment for simulating rounds in practice firing with tanks in which a pulse of light emitted by a laser mounted in a tank is utilized to simulate a round is in itself known from German Offenlegungsschrift No. 3 113 068.

Equipment for monitoring a combat vehicle, especially a tank, and used for training conducted from a director's post is also known. It involves a television camera coupled through an optical adaptor to monitoring or targeting devices in the vehicle and through a video transmission section to a television monitor located at the director's post. See for example the equipment disclosed in German Offenlegungsschriften Nos. 3 023 516, 3 023 518, and 3 023 553.

SUMMARY OF THE INVENTION

The object of the present invention is to provide equipment for monitoring combat vehicles, especially tanks, in the practice firing of simulated rounds, with a laser mounted in each combat vehicle and emitting, when the weapon's firing button is pressed, at least one pulse of light in a direction determined by the weapon or by optical targeting devices and with an optical-pulse receiver mounted in each combat vehicle and connected to displays mounted in it for intercepting the optical pulse and that can be employed to monitor all the combat vehicles participating in the practice shooting on each side and in particular each participating combat vehicle that fires or is preparing to fire a round individually.

This object is attained in accordance with the invention in that each combat vehicle is connected to monitoring equipment in which a television camera 3 is coupled in a way that is in itself known through an optical adaptor to monitoring or targeting devices in the vehicle and can be connected through a video-transmission section to a television monitor located at a director's post and in that at least two receivers in the video-transmission section are located at the director's post, each being assigned to a given group of combat vehicles and each being connected through a switcher, which can be controlled by a signal that is modulated onto each of the video signals whenever a firing button is pressed, to one television monitor, whereby the switcher includes a priority circuit that is programmed to switch the video signal emitted from a selected combat vehicle in the group to the associated monitor as long as no firing button is pressed in any combat vehicle and when a control signal is encountered, to switch the video signal emitted by the combat vehicle transmitting the control signal to the monitor for a given period of time.

Practical embodiments of the equipment in accordance with the invention are described hereinafter.

The invention consists basically of combining a device for simulating firing with a device for monitoring a combat vehicle from a director's post.

As will be described in what follows with reference to one embodiment, the equipment in accordance with the invention makes it possible to constantly monitor a particular combat vehicle from a given group, and hence from one of the two combatting sides during a training exercise. This can be done for example with a lead tank on each side. Monitoring can then be carried out such that the television pickup-equipment images that are picked up by television pickup equipment associated for example with monitoring or targeting devices operated by the gunner or commander in the lead tank are always continuously transmitted to the television pickup equipment. Naturally, the commander or gunner in the lead tank can also be selectively or alternately monitored in this way as described in German Offenlegungsschrift No. 3 023 516 or superimposed images can be transmitted as described for example in German Offenlegungsschrift No. 3 023 518.

As soon as another combat vehicle of a given group releases a round, an image derived from the television pickup equipment associated with the monitoring or targeting devices in the combat vehicle releasing the round will appear on the television monitor at the director's post for a predetermined period of time, three seconds for example. When the predetermined period expires, images deriving from the lead tank will appear again on the monitor.

The equipment in accordance with the invention makes it possible to monitor the activities of the combat vehicles on both sides and especially the mutual interchange of rounds in all phases of the training exercise from the director's post.

When the combat vehicles are equipped with system-internal distance-measurement lasers, the lasers themselves can be employed in a way that is in itself known to simulate firing. In can be practical in this case to employ a system of priorities to differentiate the distance-measurement function of the laser from the firing function. This can be done for example by providing that the pulse of light transmitted when the laser is activated has a minimal duration that is longer than that of the pulse of light transmitted in distance measurement or that a double pulse with a given minimal interval is transmitted when the laser is activated.

An especially simple embodiment of the equipment in accordance with the invention is provided wherein the distance-measurement laser is coupled with the combat vehicle's fire-control system in such a way that it will transmit no pulse of light when the distance-measuring button is pressed, whereas a given distance value will be displayed, while further operation of the fire-control system will be normal, and in that the pulse of light will be transmitted and the actual range will be displayed when the firing button is pressed. This embodiment eliminates the necessity of differentiating between the two functions of the laser because the pulse of light is not transmitted until the firing button is pressed. In this simple and especially cost-effective embodiment, the gunner has still received no information as to actual distance at the moment that the distance is measured. This information is not displayed until the round is actually fired. The fire-control system is especially simple in this embodiment. It is only necessary to ensure that a command that simulates but does not carry out a distance measurement is supplied to the fire-control system when the distance-measurement button is pressed and that a command that carries out the distance measurement and hence simulates the firing of a round is supplied to the fire-control system when the firing button is pressed. This can be done with a simple signal-adaptor for example.

Naturally, simulated firing can be carried out with a special laser that is mounted at the eyepiece of a targeting device, has the same divergence as an associated distance-measurement laser, and can be activated through the firing button is the laser employed to simulate firing both for combat vehicles with a distance-measurement laser and for combat vehicles without system-internal lasers. In this embodiment it is possible, when a system-internal laser is present, to have the laser that is employed to simulate firing operate on a different wavelength. Thus, the different functions of the lasers can be clearly differentiated and the optical-pulse receiver or reflector be designed such that only the pulses that actually arrive are recorded. It is practical to design the special laser such that the divergence of its beam is the same as that of a conventional distance-measurement laser, approximately 0.5, depending on the weapon and on the ammunition scatter.

When a particular active combat vehicle is to be monitored not only precisely while it is firing a round but even when it is preparing to fire a round, the image generated on the television monitor can be switched over even while the distance-measuring button is pressed by providing that the control signal modulated onto the video signal is transmitted to switch the video signal transmitted from a combat vehicle that is emitting the control signal to the television monitors even when the distance-measuring button is pressed.

If two combat vehicles on the same side fire simultaneously or one immediately after the other within the predetermined interval during which a switchover is made to the image associated with the combat vehicle doing the firing, the image associated with the second combat vehicle to fire can be stored and subsequently switched to the monitor in question that the video signal associated with the second control signal is retained in a memory, switched over to the television monitor upon expiration of the interval that can be predetermined, and retained there throughout a new interval that can be predetermined.

It is also practical for all the video signals supplied to the monitors to be stored for subsequent reconstruction of the practice firing in a display device. It is very practical with reference to reconstruction of the precise chronological course of events for the video signals associated with the different sides to be retained in a joint data carrier with two separate tracks to prevent displacement of the chronological course of events.

It is also practical to be able to select any vehicle on either side from the director's post in such a way that the image supplied from its monitoring or targeting devices will always appear on the appropriate monitor. This is carried out by a control signal is supplied to each switcher from the director's post and is employed to switch the video signals emitted from any of the combat vehicles in the group associated with this switcher to the television monitor. It is practical in principle for the systems data from the combat vehicle in question to be superimposed in a way that is in itself known on the images appearing on the monitors.

Hits can on the one hand be displayed in a way that is in itself known on the combat vehicle that is hit, by positioning optical-pulse receivers connected to display devices, exterior flashing lights for example, on each combat vehicle. It is an advantage in this case for the signal that controls the switcher to be transmitted from the combat vehicle that has been hit as well, so that the image of the combat vehicle that has been hit will also appear on the appropriate monitor at the director's post, and measures can also be taken to block the firing button in a combat vehicle that has been hit to prevent the vehicle from continuing to participate in the battle.

In one particularly practical embodiment of the equipment in accordance with the invention, a pulse of light is emitted both to measure the distance and to simulate firing, and a supplementary signal ensures that a pulse of light emitted to measure distance will not trigger a "hit" display. A coded firing signal is emitted for this purpose over a supplementary radio transmitter at the director's post and picked up by supplementary radio receivers in the combat vehicles. The firing signal is triggered by the signals that control the switchers when a simulated round is fired. A "hit" display will occur only when the arrival of a pulse of light and the entry of a firing signal are registered at a combat vehicle that has been hit within a predetermined interval. The firing signals for the combat vehicles assigned to the different sides are naturally differently coded. The firing signal can basically also be emitted synchronized with a round-release signal emitted in a known way to the combat vehicle that is firing.

One great advantage of this embodiment is that distance measurement and firing simulation can be clearly distinguished. Distance can then be measured again and displayed or superimposed in the form of data on the television monitors at the director's post simultaneously with firing simulation. This also allows the first distance measurement to be monitored.

This embodiment also makes it possible to reactivate a combat vehicle that has been hit with another coded radio signal transmitted from the supplementary radio transmitter at the director's post and thus render it operational again.

As already mentioned in the foregoing, the term "combat vehicles" can mean "tanks" in the context of the invention. It is, nevertheless, also possible to utilize the equipment in accordance with the invention with other types of combat vehicles as well, especially with a combination of different types, tanks and helicopters for example. The aforesaid reactivating potential can then play an important part with a type of combat vehicle with which only a few vehicles participate.

The equipment in accordance with the invention allows complete monitoring of a battle from the director's post, whereby precise situation analyses are possible by means of the preferred embodiments with respect to the display of combat vehicles that have been hit, so that duels and surprise attacks for instance can be monitored.

Some preferred embodiments of the invention will now be described with reference to the attached drawings, wherein

DETAILED DESCRIPTION OF THE PREFERRED EMBODIMENTS

Figure 1:
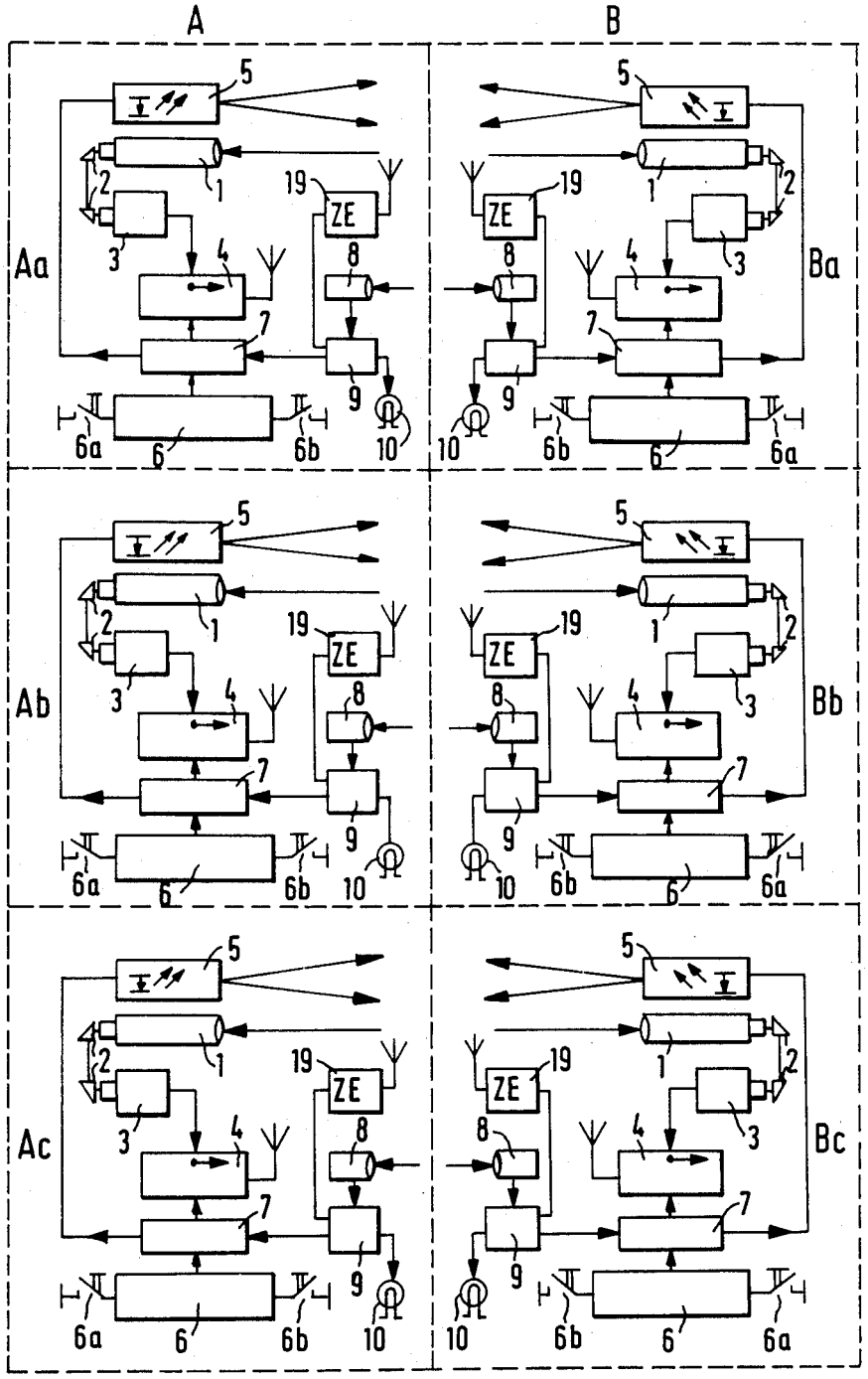
FIG. 1 is a block diagram of the device located in the combat vehicles in connection with equipment in accordance with the invention.

FIG. 1 illustrates the devices installed in six tanks. Three tanks Aa, Ab, and Ac belong to one side A and three tanks Ba, Bb, and Bc to the other side B. Each side could of course have a larger number of tanks and a total of up to 20 vehicles for example can easily be monitored. Tanks Aa and Ba are the lead tanks.

All the tanks are similarly equipped and the same reference numbers are employed for the same type of equipment in every tank. Each tank has a monitoring or targeting devices 1, to which a television camera 3 is coupled through an optical adaptor 2. Each television camera 3 is also connected to a telemetry transmitter 4 and has a fire-control system 6 with a firing button 6*a* and a distance-measuring button 6*b*. The fire-control system 6 is connect to a distance-measurement laser 5 through controls 7. Each tank also has an optical-pulse receiver 8 that is connected through a processor 9 on the one hand to a disp1ay 10, a flashing light for example, and on the other to controls 7.

Controls 7, which are represented in greater detail in FIG. 5 and will be described in greater detail later herein, have various functions. They ensure on the one hand that laser 5 will emit an initial pulse of light to measure the distance when distance-measuring button 6*b* is pressed. A control signal can simultaneously be generated even at that time that can be modulated onto the video signal emitted by telemetry transmitter 4. Laser 5 is reactivated and a pulse of light transmitted when firing button 6*a* is pressed. A control signal that is modulated onto the video signal emitted from telemetry transmitter 4 is simultaneously generated by controls 7. Finally, controls 7 can also contain units 7*b*' and 7*b*'' (FIG. 5) that add supplementary signals, signals that transmit systems data for example, to the video signal that is to be transmitted. Signals that can be supplied from processor 9 when, as will be described later herein, optical-pulse receiver 8 picks up a signal indicating that a vehicle has been hit, can also be supplied to controls 7. The control signal is generated and supplied to telemetry transmitter 4 in this case as well.

Display 10 is also activated when a firing signal is received from a supplementary radio receiver 19 within a predetermined interval of time as will be described in greater detail later herein.

Figure 2:
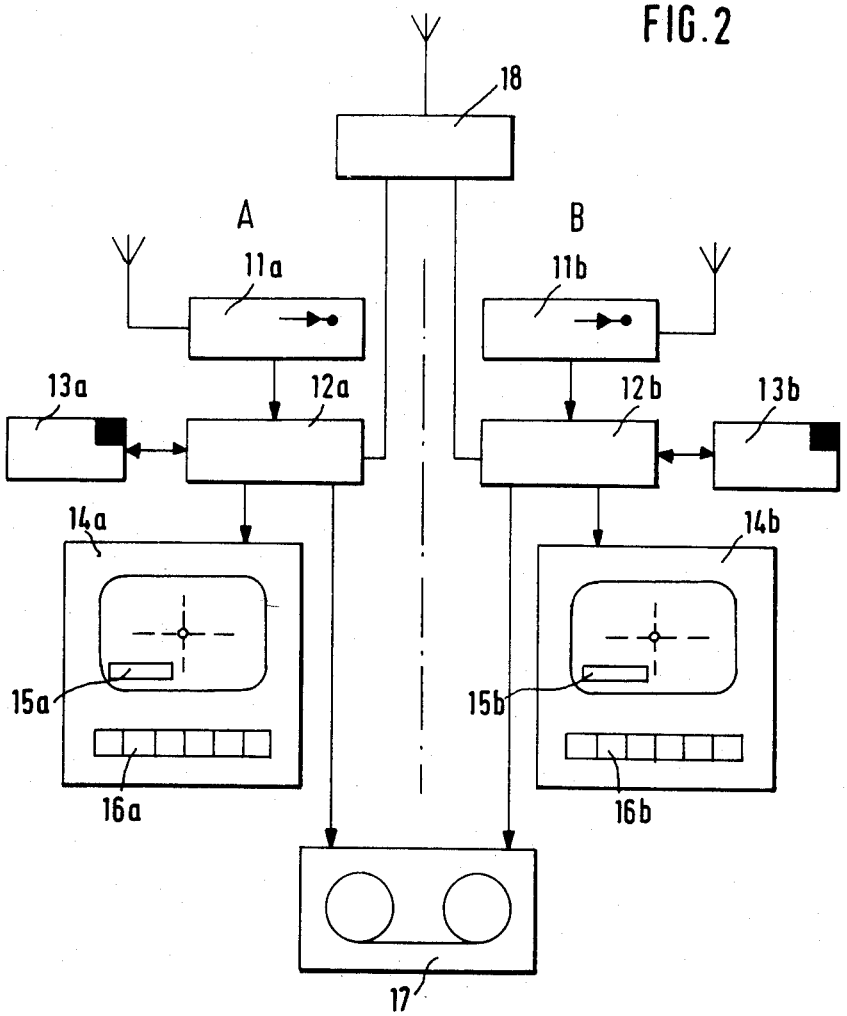
FIG. 2 is a block diagram of the devices located at the director's post in connection with equipment in accordance with the invention.

FIG. 2 illustrates the portion of the overall equipment located at the director's post. There are two telemetry receivers 11*a* and 11*b* connected to television monitors 14*a* and 14*b* over decoder-switchers 12*a* and 12*b* respectively. Memories 13*a* and 13*b* are also connected to decoder-switchers 12*a* and 12*b*. In addition to the images transmitted from monitoring or targeting devices 1, a specific data field 15*a* or 15*b* also appears on the screen of each television monitor 14*a* or 14*b*, its position and size being variable as desired within the major image. The data field may contain systems data, indications as to target range, type of ammunition, etc. for example as well as a time display and "hit" signal.

The functions of the portions of the overall equipment located at the director's post can be controlled from keyboards 16*a* and 16*b*. Equipment components 11*a*, 12*a*, 13*a*, and 14*a* are all assigned to side A in FIG. 1 and Components 11*b*, 12*b*, 13*b*, and 14*b* to side B. The images displayed by television monitors 14*a* or 14*b* are simultaneously supplied to a videorecorder 17, where they are stored on a display carrier with two tracks.

A radio transmitter 18 that emits a coded signal when a control signal arrives at one of the telemetry receivers 11*a* and 11*b* is also connected to decoder-switcher 12*a* or 12*b*. The coded signal is always coded differently in accordance with which of the two telemetry receivers 11*a* and 11*b* receives the control signal.

Decoder-switchers 12*a* and 12*b* contain a video logic circuit that is not illustrated and that consists of devices that are in themselves known. The video logic circuit decodes the signals received from telemetry receivers 11*a* and 11*b* and triggers commercially available video switches corresponding to the control signals contained in the signals. The video switches supply signals to units 13*a* and 14*a* or 13*b* and 14*b* and to videorecorder 17 and radio transmitter 18.

Figure 3:
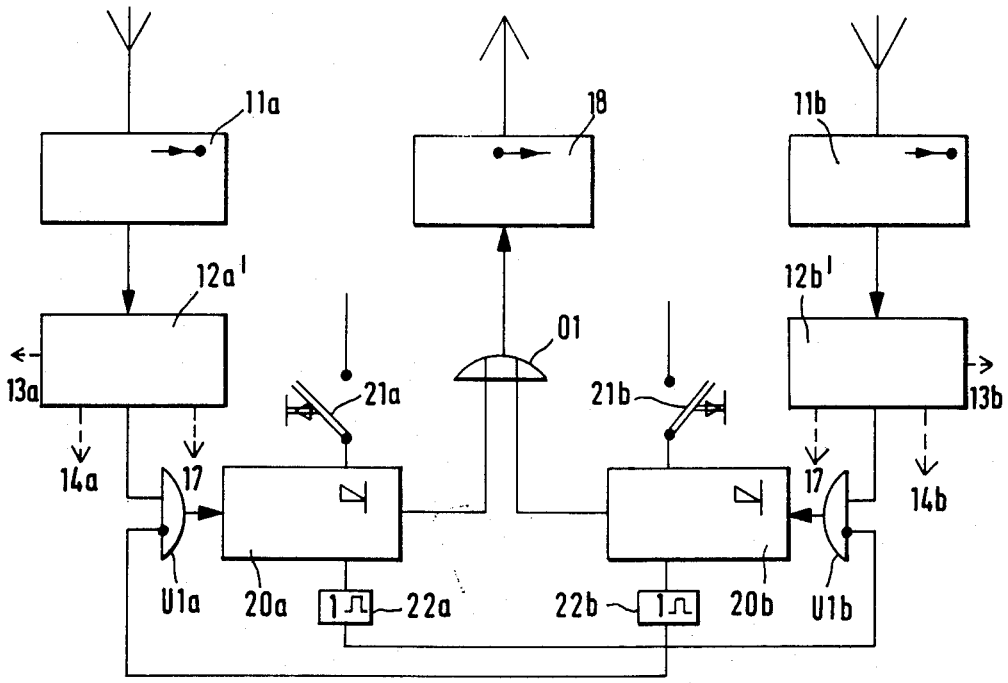
FIG. 3 is a detail of FIG. 2 illustrating particulars of the logical signal processing that occurs at the director's post.

Details as to the logical processing of the control signal in this context can be derived from the circuitry illustrated in somewhat greater detail in FIG. 3. The devices 13*a*, 14*a*, 13*b*, 14*b*, and 17 in FIG. 2 are not illustrated in FIG. 3 for simplicity's sake. The devices U1*a*, 20*a*, 21*a*, and 22*a* or U1*b*, 20*b*, 21*b* and 22*b* in FIG. 3 are to be understood as components of the device 12*a* in FIG. 2. The devices that contain the video logic circuit and the video switch are accordingly labeled 12*a*' and 12*b*' in FIG. 3. The OR gate O1 in FIG. 3 is to be understood as located inside the radio transmitter 18 in FIG. 2. When a control signal that indicates the firing of a round arrives at telemetry receiver 11*a*, decoder-switcher 12*a*' supplies a control signal to a modulator 20*a* over an AND gate U1*a* when there is no signal at the second input of the AND gate U1*a* which indicates that a corresponding control signal has just been received from telemetry receiver 11*b*. Radio transmitter 18 is triggered by modulator 20*a* over an OR gate O1 and transmits the coded firing signal. A blocking signal is simultaneously transmitted for a predetermined period of time from modulator 20*a* via a monostable flip-flop 22*a* to AND gate U1*b*, through which the decoder-switcher 12*b*' that is connected to telemetry receiver 11*b* is connected to a corresponding modulator 20*b*. Radio transmitter 18 can be similarly triggered from modulator 20*b* through OR gate O1 to emit another coded firing signal. Modulator 20*b* is connected to the negated input of AND gate U1*a* through a montostable flip-flop 22*b*.

It is also possible to trigger modulator 20*a* or 20*b* with reactivation buttons 21*a* or 21*b* to release coded reactivating signals from radio transmitter 18. The reactivating signals can as will be described later herein be picked up by a radio receiver 19 assigned to a particular combat vehicle.

Figure 4:
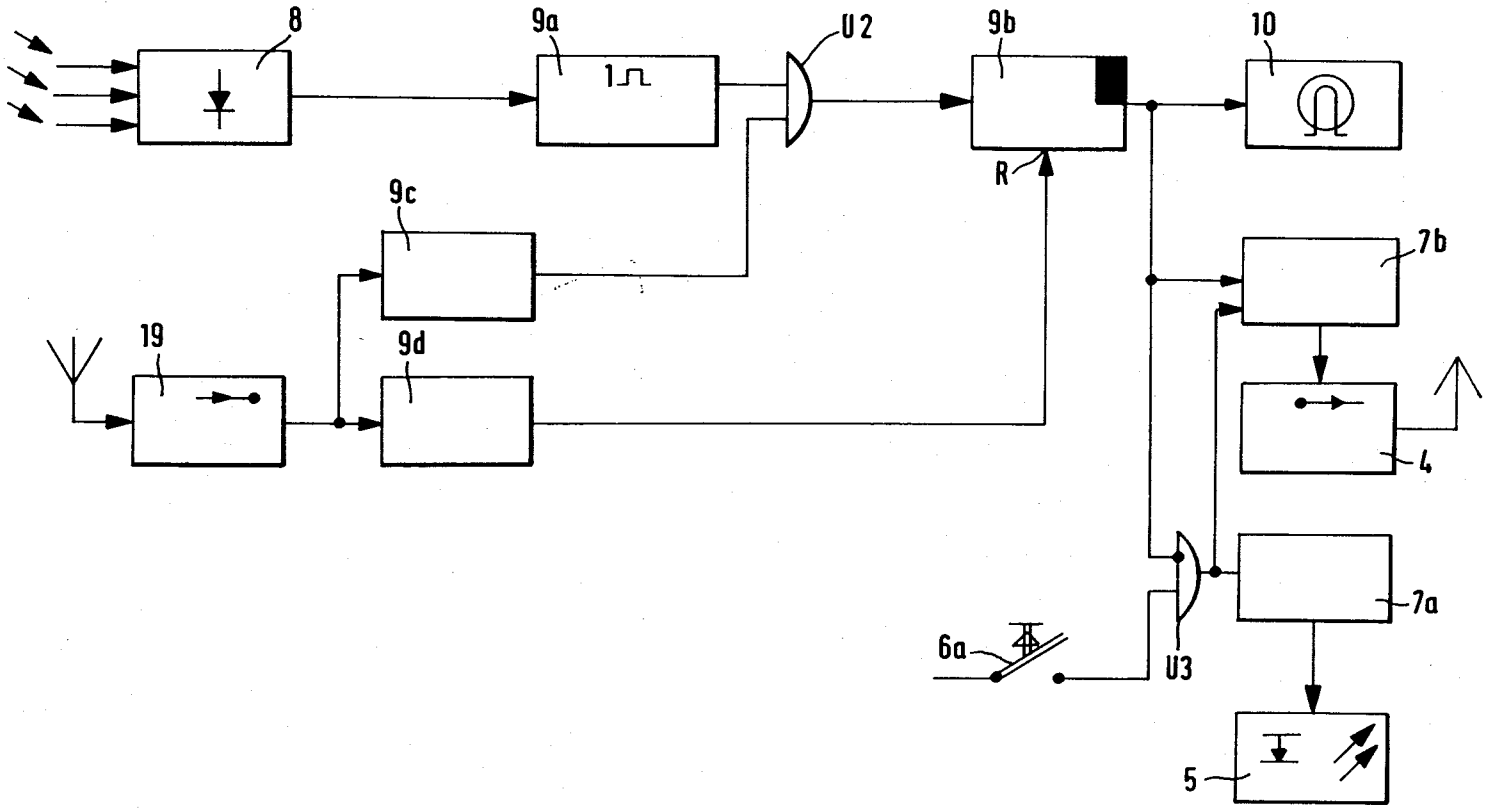
FIG. 4 is a detail of FIG. 1 illustrating particulars of the logical signal processing that occurs in the combat vehicles.

FIG. 4 illustrates how the firing signals and reactivating signals deriving from the radio transmitter 18 at the director's post are processed by the portions of the overall equipment in the combat vehicles. The fire-control system 6 illustrated in FIG. 1 is not illustrated in the more simplified FIG. 4 and it is assumed that firing button 6*a* affects controls 7, which are here illustrated part by part, directly, whereby device 7*a*, which can be a relay or a commercially available electronic control device for example, generates the signal that controls laser 5, whereas device 7b, which can contain a commercially available modulator, generates the control signals supplied to telemetry transmitter 4. Devices 7a and 7b are to be understood as part of the controls 7 in FIG. 1.

Optical-pulse receivers 8 are connected to a memory 9b through a monostable flip-flop 9a and an AND gate U2. The second input of AND gate U2 is connected to radio receiver 19 through a decoder 9c. Radio receiver 19 is also connected to the zeroing or reset input of memory 9b through another decoder 9d. If a firing signal enters radio receiver 19 within a period of time that is determined by monostable flip-flop 9b subsequent to the entry of a pulse of light into device 8, AND gate U2 opens and supplies a setting pulse to memory 9b with the result that the memory activates display 10. Control device 7b is simultaneously activated and causes the control signal to be transmitted by the combat vehicle's telemetry transmitter 4. A signal is also supplied to one negated input of another AND gate U3. Firing button 6a is connected to control device 7a, which causes laser 5 to emit a pulse of light, through AND gate U3. Thus, as will be evident from the drawing, no more pulses of light can be emitted to simulate firing when display 10 is on.

If a reactivating signal is received from radio receiver 19, memory 9b is reset through decoder 9d, display 10 turned off again, and AND gate U3 released.

Figure 5:
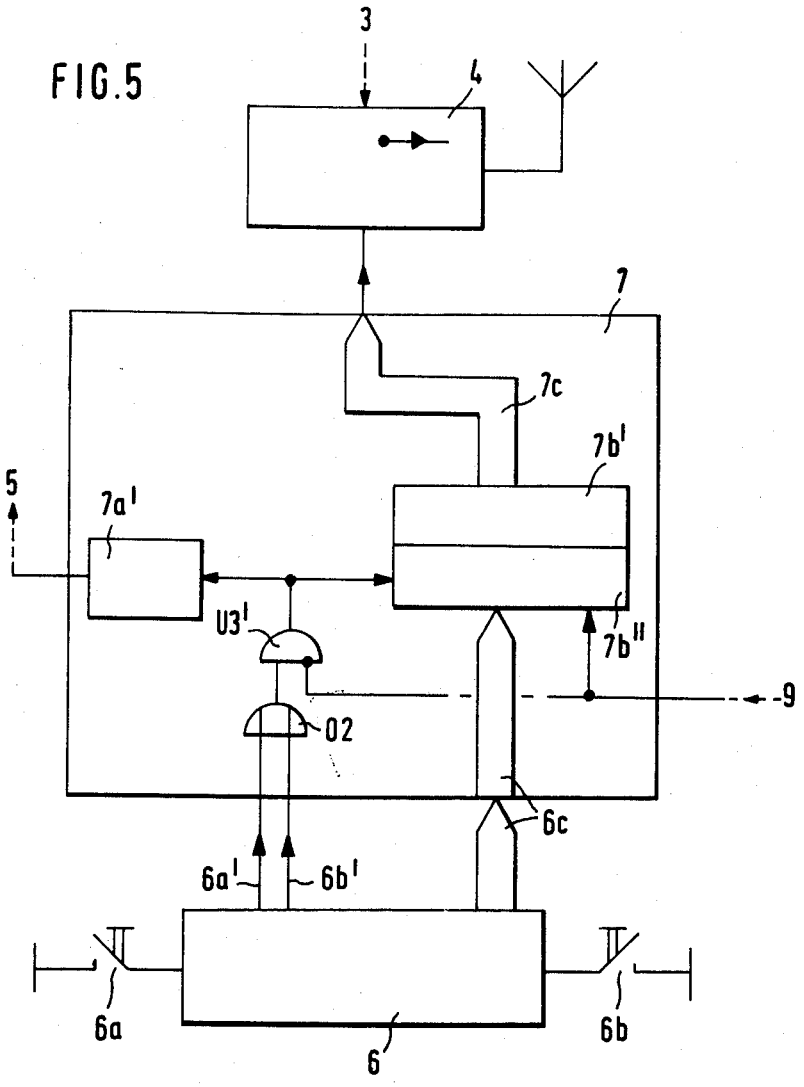
FIG. 5 is another detail of FIG. 1 illustrating particulars of the control in a combat vehicle.

FIG. 5 illustrates the controls 7 in FIG. 1 in somewhat greater detail for purposes of clarification. Fire-control system 6 can be constructed in a way that is known for combat vehicles and that is not illustrated in greater detail and generally contains a fire-control computer with switching circuits, safety circuits or circuits that release and ammunition-selection signal for example, connected to it. Fire-control systems with a fire-control computer are described in U.S. Pat. Nos. 3,538,318 and 3,739,152 for example. A switching circuit for inputting an ammunition-selection signal into a fire-control computer is the object of U.S. Pat. No. 4,125,055, whereas a switching arrangement for securing electrically activated weapons systems is described in German Offenlegungsschrift No. 2 703 803.

When firing button 6a or distance-measuring button 6b is pressed, fire-control system 6 releases signals over lines 6a' or 6b' and via an OR gate O2 to a AND gate U3' that also has a negated input and that corresponds to the AND gate U3 in FIG. 4. Control device 7a' can correspond to the control device 7a in FIG. 4 and can for example be a relay. AND gate U3' emits a signal when there is no signal from processor 9 (FIG. 1) at its negated input. The signals arriving from processor 9 and from AND gate U3' are simultaneously supplied through a data interface 7b'' to a character-superimposition device 7b'. Data as to range, type of ammunition, and firing readiness arriving from fire-control system 6 over a data line 6c can likewise be supplied to character-superimposition device 7b' over data interface 7b''. The data interface and the character-superimposition device can be designed along known commercially available lines. The devices supplied by the firm of Bosch under numbers T1246 and T1245 can be employed here for example. The signals to be superimposed over the television image and the control signals can be supplied from character-superimposition device 7b' to telemetry transmitter 4 over line 7c.

The function of the equipment described with reference to FIGS. 1 through 4 will now be summarized.

In normal training exercises, when none of the firing buttons 6a or distance-measuring buttons 6b in any of the tanks on sides A or B that are participating in the battle are pressed, the images picked up by the monitoring or targeting devices 1 in the two lead tanks Aa and Ba will appear on the screens of the two television monitors 14a and 14b. The image from the commander's optics and the image from the gunner's optics can, as previously described herein, appear together in a combined image. Appropriate systems data can also be already displayed in data fields 15a and 15b.

If, now, tank Ab on side A picks up a target and intends to attack it, the distance-measuring button 6b in that tank will be pressed and the range taken in the usual manner. Controls 7 will then transmit a control signal to the telemetry transmitter 4 of tank Ab. The signal will switch the decoder-switcher 12a at the director's post to video signal from tank Ab and the image picked up by the monitoring or targeting device 1 in tank Ab will appear on the screen of television monitor 14a. If the firing button 6a in tank Ab is pressed, distance-measurement laser 5 will emit another pulse of light to simulate firing and the radio transmitter 18 at the director's post will transmit a firing signal. If the target, tank Bb on side B for example, is hit, the pulse of light will be picked up by the optical-pulse receiver 8 on tank Bb and, if processors 9 or 9a, 9b simultaneously receive the firing signal from radio receiver 19, external display 10 will be activated, which can simultaneously be observed on the screen of television monitor 14a at the director's post. The image picked up by the monitoring or targeting device 1 in tank Bb will simultaneously appear on the screen of television monitor 14b along with the superimposed systems data.

Subsequent to a predetermined period of time, 3 seconds for instance, decoder-switchers 12a and 12b will switch over again and the images generated by the monitoring or targeting devices 1 in lead tanks Aa and Ba will appear again on the screens of television monitors 14a and 14b along with the superimposed systems data. The portion A of the overall equipment illustrated in FIG. 2 will then be ready for the next activity on the part of one of the tanks on side A.

The same procedures occur similarly at television monitors 14a and 14b when one of the tanks on side B, tank Bb for example, picks up a target and fires a round.

When another tank on side A, tank Ac for example, picks up a target and begins to fire during the predetermined time of 3 seconds after tank Ab fires a round, there is at first no switching on the part of decoder-switcher 12a, but the signals emitted from the telemetry transmitter 4 on tank Ac are supplied from telemetry receiver 11a through decoder-switcher 12a to memory 13a, where they are stored. Upon expiration of the previously initiated time of 3 seconds, the signal stored in memory 13a is switched to the screen of television monitor 14a, where it is displayed for 3 seconds. The context of the time sequence of the displayed images can be read off at any time from the real-time figures in data field 15a. It is of course also possible to design the equipment so that several video signals arriving in sequence in memory 13a can be stored and then emitted again in the sequence in which they arrived.

The same procedures occur similarly in the portion of the equipment assigned to side B when the appropriate video signals are emitted by two of the tanks on side B within the predetermined period of time.

The overall process can be monitored from the director's post independent of firing by selecting any tank on either side by means of keyboards 16*a* and 16*b*, whereby the particular image from the monitoring or targeting device 1 on the tank selected will appear on the screens of television monitors 14*a* or 14*b*.

What is claimed is:

1. In equipment for monitoring two groups of combat vehicles in the practice firing of simulated rounds, wherein each combat vehicle has a weapon, a firing button for the weapon, a laser for emitting at least one pulse of light in a direction determined by the weapon when the firing button is actuated, an optical targeting device, an optical-pulse receiver for receiving a light pulse and a display connected to the optical pulse receiver for indicating the receipt of a pulse, the improvement comprising means for monitoring the combat vehicles at a director's post remote from the combat vehicles comprising in each combat vehicle: a television camera; optical adapting means coupling the optical targeting device to the television camera; video-transmitting means for transmitting the output of the television camera to the director's post; and means for modulating a control signal onto the transmitted video signal when the firing button is actuated; and comprising at the director's post at least two video receivers each assigned to one group of combat vehicles; one television monitor for each video receiver; switching means connecting each receiver to its associated monitor and controlled by the control signal for selecting the video signal displayed on the monitor, the switching means comprising a priority circuit for applying the video signal from a selected combat vehicle in the group to the associated monitor when no firing button is actuated in any combat vehicle and for applying to the monitor for a given period of time the video signal emitted by a combat vehicle transmitting the modulated control signal.

2. The equipment as in claim 1, wherein the targeting device has an eyepiece and the laser is mounted at the eyepiece of the targeting device.

3. The equipment as in claim 1, wherein the laser in each combat vehicle comprises a distance-measurement laser.

4. The equipment as in claim 3, wherein the distance measurement laser includes means to emit a light pulse of given duration for distance measurement and means whereby the pulse of light transmitted when the laser is activated by the firing button has a minimum duration that is longer than that of the pulse of light transmitted in distance measurement.

5. The equipment as in claim 4, further including means whereby a double pulse with said minimum interval is transmitted when the laser is activated by the firing button.

6. The equipment as in claim 3, wherein the distance-measurement laser includes a distance measuring button means for actuating same and each combat vehicle has a fire control system and further comprising means coupling the laser with the combat vehicle's fire-control system so that no pulse of light is transmitted when the distance-measuring button is actuated and a pulse of light is transmitted when the firing button is actuated.

7. The equipment as in claim 6, wherein the modulating means modulates the control signal onto the video signal when the distance-measuring button is actuated.

8. The equipment as in claim 1, wherein the priority circuit has means responsive to a control signal transmitted from another combat vehicle of the same group arriving before the end of the given period for storing the video signal associated with the control signal and for applying the stored signal to the television monitor upon expiration of the given time period for a selected interval.

9. The equipment as in claim 1, further comprising means for recording the video signals supplied to the television monitors comprising a video recorder with a joint data carrier, wherein the data carrier has a track for each video signal associated with a specific television monitor.

10. The equipment as in claim 1, further comprising means disposed at the director's port for switching the video signals emitted from any of the combat vehicles in a group to the associated television monitor.

11. The equipment as in claim 1, further comprising means disposed in each combat vehicle and connected to the optical-pulse receivers for superimposing data on the transmitted video signal.

12. The equipment as in claim 1, further comprising means disposed in a combat vehicle and connected to the optical pulse receiver for blocking actuation of the firing button.

13. The equipment as in claim 1, further comprising means connecting the optical-pulse receiver to the modulating means in each combat vehicle.

14. The equipment as in claim 1, further comprising a radio transmitter positioned at the director's post and a radio receiver in each combat vehicle receptive of signals from the transmitter, means responsive to the control signal for effecting transmission of a coded firing signal from the transmitter and means enabling the display connected to the optical-pulse receiver in each combat vehicle to indicate the receipt of a pulse of light in the combat vehicle when the coded firing signal is received within a predetermined interval from the receipt of the pulse by the optical pulse receiver.

15. The equipment as in claim 14, further comprising means for effecting transmission of a coded reactivation signal over the radio transmitter at the director's post to the radio receivers to each combat vehicle to reset the displays indicating receipt of a pulse of light.

* * * * *